US006395443B2

(12) United States Patent
Kuroda et al.

(10) Patent No.: US 6,395,443 B2
(45) Date of Patent: May 28, 2002

(54) TONER FOR DEVELOPING ELECTROSTATIC IMAGE AND PROCESS OF PREPARING SAME

(75) Inventors: Noboru Kuroda, Tagata-gun; Tomoyuki Satoh, Numazu; Yasushi Nakamura, Fujinomiya; Nobutaka Kinoshita, Mishima; Masahiro Kawamoto, Tagata-gun; Shigeru Emoto, Numazu; Osamu Kouzu, Fuji, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/725,276

(22) Filed: Nov. 29, 2000

(30) Foreign Application Priority Data

Nov. 29, 1999 (JP) ..... 11-337808

(51) Int. Cl.[7] ..... G03G 9/083
(52) U.S. Cl. ..... 430/110.4
(58) Field of Search ..... 430/110.4, 137.21

(56) References Cited

U.S. PATENT DOCUMENTS 6,074,795 A 6/2000 Watanabe et al. ..... 430/109
6,159,647 A * 12/2000 Anno et al. ..... 430/110.4
6,180,298 B1 1/2001 Kuroda et al. ..... 430/45
6,183,926 B1 * 2/2001 Kuroda et al. ..... 430/110.4
6,200,719 B1 3/2001 Kuroda ..... 430/110

* cited by examiner

*Primary Examiner*—John Goodrow
(74) *Attorney, Agent, or Firm*—Oblon, Spivak, McClelland, Maier & Neustadt, P.C.

(57) ABSTRACT

A toner for developing an electrostatic image, including a binder, a coloring agent and a charge controlling agent. When that portion of the toner which has a particle diameter of 5.04 μm or less accounts for 15–60% of the total number N of the toner, that portion of the toner which provides a number average particle diameter of 4.0 to 4.5 μm has such a content C1% by weight of the charge controlling agent that gives a ratio of C1/CT of 1.00 to 1.10, where CT is a total amount, in terms of % by weight, of the charge controlling agent in the toner. When that portion of the toner which has a particle diameter of 5.04 μm or less accounts for 15% or less of the total number N, that portion of the toner which provides a number average particle diameter of 4.2 to 4.8 μm has such a content C2% by weight of the charge controlling agent that gives a ratio of C2/CT of 1.02 to 1.15.

6 Claims, No Drawings

TONER FOR DEVELOPING ELECTROSTATIC IMAGE AND PROCESS OF PREPARING SAME

BACKGROUND OF THE INVENTION

This invention relates to a toner for developing electrostatic latent images and to a process for the preparation thereof.

In an electrophotographic method, latent electrostatic images formed on a photoconductor are developed into visible toner images with a toner by a suitable method such as a magnetic brush method, a cascade method or a powder cloud method. Then, the toner images are transferred to a sheet of copy paper and fixed thereon, for instance, by the application of heat using heat-application means such as a heated roller or solvent vapors.

For the purpose of controlling triboelectricity of the toner, a charge controlling agent is generally incorporated thereinto. Such a toner is generally prepared by a method in which a binder, a coloring agent and a charge controlling agent are mixed in a powder state. The resulting mixture is then melted and kneaded, followed by solidification, grinding and classification.

Since the state of the charge controlling agent on toner particles greatly varies with conditions, such as mixing and grinding conditions, of the toner manufacturing process, it is difficult to properly control the triboelectricity. Thus, one problem of the above ground toner is concerned with the presence of particles which do contain a desired amount of the charge controlling agent. Such particles, which do not have desired triboelectricity, are apt to migrate on non-image portions of an electrostatic image-bearing photoconductor surface to cause background stains.

In this circumstance, a method is proposed in which a charge controlling agent is not kneaded with a binder and a coloring agent but is adhered to surfaces of kneaded and ground particles of the binder and the coloring agent (JP-A-63-2075). The toner obtained by this method, however, does not have satisfactory service life, because the adhered charge controlling agent receives influence of temperature, moisture, etc. Japanese patent No. 2825615 proposes a method in which an additional charge controlling agent is adhered to surfaces of kneaded and ground particles of the charge controlling agent, a binder and a coloring agent. This method, however, has a problem because the manufacturing efficiency is not high and requires high manufacturing costs.

SUMMARY OF THE INVENTION

It is, therefore, an object of the present invention to provide a toner for developing an electrostatic image, which can give a high quality image having no background stains.

Another object of the present invention is to provide a simple process which can produce the above toner.

It has been found that, when a kneaded and solidified mixture containing a binder, a coloring agent and a charge controlling agent is ground into toner particles, the grinding preferentially occurs at the interfaces between the binder and the charge controlling agent which is not compatible with the binder. As a consequence, the charge controlling agent preferentially exposes on the surfaces of the ground particles. It has also been found that the content of the charge controlling agent in smaller toner particles is higher than that in larger toner particles. However, the amount of toner particles which do not contain the charge controlling agent and which will cause background stains is greater in particles having very small diameters. It has now been found that the number percentage of toner particles having a particle diameter of 5.04 μm or less plays an important role in prevention of background stains in the case of a toner having a weight average particle diameter of 6.0–11.5 μm.

In accordance with the present invention there is provided a toner for developing an electrostatic image, comprising a binder, a coloring agent and a charge controlling agent and having the following characteristics (a), (b), (c), (d) and (e):

(a) said toner has a weight average particle diameter of 6.0 to 11.5 μm, a total particle number N and a total weight W;

(b) that portion of said toner which has a particle diameter of 5.04 μm or less accounts for greater than 15% but not greater than 60% of the total number N of said toner and has a number average particle diameter of 4.0 to 4.5 μm;

(c) that portion of said toner which has a particle diameter of greater than 5.04 μm but not greater than 12.7 μm accounts for 40 to 90% of the total number N of said toner and has a weight average particle diameter of 6.0 to 9.5 μm;

(d) that portion of said toner which has a particle diameter of 16 μm or more is not more than 2% based on the total weight W of said toner; and (e) that portion of said toner which provides a number average particle diameter of 4.0 to 4.5 μm has such a content C1% by weight of the charge controlling agent that gives a ratio of C1/CT of 1.00 to 1.10, where CT is a total amount, in terms of % by weight, of said charge controlling agent in said toner.

In another aspect, the present invention provides a process for the preparation of the above toner, said process comprising the steps of:

mixing the binder in the form of a powder, the coloring agent in the form of a powder and the charge controlling agent in the form of a powder to obtain a mixture;

kneading said mixture at a temperature higher than the melting point of said binder;

solidifying the kneaded mixture and grinding the solidified mixture; and sieving said ground mixture, said kneading being carried out while applying a specific energy of at least 0.15 kW·h/kg to the mixture.

The present invention further provides a toner for developing an electrostatic image, comprising a binder, a coloring agent and a charge controlling agent and having the following characteristics (a), (b'), (c), (d) and (e'):

(a) said toner has a weight average particle diameter of 6.0 to 11.5 μm, a total particle number N and a total weight W;

(b') that portion of said toner which has a particle diameter of 5.04 μm or less accounts for 15% or less of the total number N of said toner and has a number average particle diameter of 4.2 to 4.8 μm;

(c) that portion of said toner which has a particle diameter of greater than 5.04 μm but not greater than 12.7 μm accounts for 40 to 90% of the total number N of said toner and has a weight average particle diameter of 6.0 to 9.5 μm;

(d) that portion of said toner which has a particle diameter of 16 μm or more is not more than 2% based on the total weight W of said toner; and (e) that portion of said toner which provides a number average particle diameter of 4.2 to 4.8 μm has such a content C2% by weight of the charge controlling agent that gives a ratio of C2/CT of 1.02 to 1.15, where CT is a total amount, in terms of % by weight, of said charge controlling agent in said toner.

The present invention further provides a process for the preparation of a toner described immediately above, said process comprising the steps of:

mixing the binder in the form of a powder, the coloring agent in the form of a powder and the charge controlling agent in the form of a powder to obtain a mixture;

kneading said mixture at a temperature higher than the melting point of said binder;

solidifying the kneaded mixture and grinding the solidified mixture; and sieving said ground mixture, said kneading being carried out while applying a specific energy of at least 0.1 kW·h/kg to the mixture.

Other objects, features and advantages of the present invention will become apparent from the detailed description of the preferred embodiments of the invention to follow.

DETAILED DESCRIPTION OF THE PREFERRED EMBODIMENTS OF THE INVENTION

A toner for use in image forming according to the present invention comprises a binder, a coloring agent and a charge controlling agent and has a weight average particle diameter of 6.0 to 11.5 μm, preferably 6–8 μm, a total particle number N and a total weight W. When the weight average particle diameter is less than 6.0 μm, there are apt to cause problems such as fouling of inside of the image forming machine by toner dispersion, reduction of image density under low humidity conditions and difficulty in maintaining clean surface of the photoconductor. A weight average particle diameter of the toner in excess of 11.5 μm will cause lowering of the image quality because of insufficient resolution of fine spots constituting the image, although there is less tendency to cause background stains.

That portion ($P_{5.04-}$) of the toner which has a particle diameter of 5.04 μm or less should not be greater than 60% of the total particle number N of the toner. In this case, when such portion ($P_{5.04-}$) accounts for greater than 15% but not greater than 60% of the total particle number N of the toner, the number average particle diameter of the portion ($P_{5.04-}$) should be 4.0 to 4.5 μm. When the portion ($P_{5.04-}$) accounts for 15% or less of a total number of the toner, the number average particle diameter of the portion ($P_{5.04-}$) should be 4.2 to 4.8 μm. When the number average particle diameter is less than the above range, the amount of fine particles is so large that the fluidity of the toner becomes unsatisfactory.

That portion ($P_{5.04-12.7}$) of the toner which has a particle diameter of greater than 5.04 μm but not greater than 12.7 μm should account for 40 to 90% of the total particle number N of the toner and should have a weight average particle diameter of 6.0 to 9.5 μm.

That portion ($P_{16+}$) of the toner which has a particle diameter of 16 μm or more should be no more than 2% based on the total weight W of the toner. When such large toner particles are present more than 2% by weight, a high grade image is hardly obtainable.

When the portion ($P_{5.04-}$) of the toner which has a particle diameter of 5.04 μm or less accounts for greater than 15% but not greater than 60% of the total particle number N of the toner, it is important that the content C1 (% by weight) of the charge controlling agent contained in that portion ($Pav_{4.0-4.5}$) of the toner which provides a number average particle diameter of 4.0 to 4.5 μm should provide a ratio of C1/CT of 1.00 to 1.10, preferably 1.00– 1.08, where CT is a total amount, in terms of % by weight, of the charge controlling agent in the toner.

A C1/CT ratio of more than 1.10 causes background stains because of the presence of fine particles which do not contain the charge controlling agent.

When the portion ($P_{5.04-}$) of the toner which has a particle diameter of 5.04 μm or less accounts for 15% or less of the total particle number N of the toner, on the other hand, it is important that the content C2 (% by weight) of the charge controlling agent contained in that portion ($P_{av4.2-4.8}$) of the toner which provides a number average particle diameter of 4.2 to 4.8 μm should provide a ratio of C2/CT of 1.02 to 1.15, preferably 1.02–1.12, where CT is a total amount, in terms of % by weight, of the charge controlling agent in the toner.

Too large a C2/CT ratio in excess of 1.15 causes background stains because of the presence of fine particles which do not contain the charge controlling agent. A C2/CT ratio of less than 1.02 does not give any additional merit and, rather, is disadvantageous from the standpoint of economy because the production efficiency for the toner decreases.

Since it is practically difficult to isolate only that portion of the toner having a particle diameter of 5.04 μm or less, the amount of the charge controlling agent in that portion cannot be measured. Thus, in the present invention, the amount of the charge controlling agent contained in the portion ($P_{av4.0-4.5}$) of the toner which provides a number average particle diameter of 4.0 to 4.5 μm or in the portion ($P_{av4.2-4.8}$) of the toner which provides a number average particle diameter of 4.2 to 4.8 μm is used as a representative of the amount of the charge controlling agent contained in small diameter particles of a given toner. Such a portion ($P_{av4.0-4.5}$) or ($P_{av4.2-4.8}$) can be obtained by classification of the given toner.

The amount of the charge controlling agent in a toner sample is measured using a wavelength dispersion-type fluorescent X-ray analyzer (Model RIX3000 manufactured by Rigaku Denki Kabushiki Kaisha). The sample (3 g) is pressed at 10 tons with a disk forming machine to form a pellet having a diameter of 40 mm. The pellet is measured with the fluorescent X-ray analyzer at an output voltage of 50 kV. From the intensity of a peak inherent to the charge controlling agent, the concentration of the charge controlling agent is determined. When C1=CT or C2=CT, the charge controlling agent is regarded as being uniformly distributed in the toner particles.

The particle diameter distribution of the toner is measured with a Coulter counter (Model TA-II manufactured by Coulter Electronics, Inc.). The Coulter counter is used in association of an interface (manufactured by Nikkaki Inc.) adapted to output number distribution and volume distribution and a personal computer. As an electrolytic solution for measurement, an aqueous 1% by weight NaCl solution of first-grade sodium chloride is used. Measurement is carried out by adding, as a dispersant, 0.1–5 ml of a 30% solution of Drywell (manufactured by Fuji Photo Film Co., Ltd.) to 10 to 15 ml of the above electrolytic solution, and further adding 2 to 20 mg of a sample to be measured. The resulting mixture is subjected to dispersion for about 1 minute to about 3 minutes in an ultrasonic dispersing machine. The electrolytic solution (100–200 ml) is taken in another vessel, to which a predetermined amount of the dispersed sample is added so that the particle count through 1 minute is about 30,000. Using an aperture of 100 μm in the above particle size distribution measuring device, the particle size distribution is measured on the basis of the number with the Coulter counter for particles having a diameter in the range of 2–40 μm. The weight average particle diameter (D4) of the toner is determined from that weight distribution. The median value of each channel is used as the representative of that channel.

Any binder for toners, such as a vinyl resin, a polyester resin or a polyol resin, may be used for the purpose of the present invention.

Examples of the vinyl resins include polystyrene resins such as polystyrene and polyvinyltoluene; styrene copolymers such as styrene-p-chlorostyrene copolymer, styrene-polypropylene copolymer, styrene-vinyltoluene copolymer, styrene-methylacrylate copolymer, styrene-ethylacrylate copolymer, styrene-butylacrylate copolymer, styrene-α-methylchlormethacrylate copolymer, styrene-acrylonitrile copolymer, styrene-vinylmethylether copolymer, styrene-vinylmethylketone copolymer, styrene-butadiene copolymer, styrene-isoprene copolymer, styrene-maleic acid copolymer, and styrene-maleate copolymer; acrylic resins such as polymethyl acrylate and polybutyl methacrylate; polyvinylchloride and polyvinylacetate.

The polyester resin is a polycondensation product of a polyhydric alcohol and a polybasic acid. Examples of polyhydric alcohols include diols such as ethylene glycol, diethylene glycol, triethylene glycol, 1,2-propylene glycol, 1,3-propylene glycol, 1,4-butane diol, neopentyl alycol, and 1,4-butenediol, 1,4-bis(hydroxymethyl)cyclohexane; bisphenol A, hydrogenated bisphenol A, bisphenol A etherificated with polyoxyethylene, polyoxypropylene(2,2)-2,2'-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, polyoxypropylene(2,0)-2,2'-bis(4-hydroxyphenyl)propane, trihydric or higher alcohol monomers such as glycerol, trimetylolpropane, sorbitol, and pentaerythritol.

Examples of the polybasic carboxylic acid include:

dibasic organic acid monomers such as maleic acid, fumalic acid, mesaconic acid, citraconic acid, itaconic acid, glutaconic acid, phthalic acid, isophthalic acid, terephthalic acid, cyclohexane dicarboxycylic acid, succinic acid, adipic acid, sebatic acid, malonic acid, linolenic, acid anhydrides thereof, and esters thereof with a lower alcohol; tri or more polybasic acids such as trimellitic acid and pyromellitic acid.

Examples of polyol resins include resins obtained by reacting (a) an epoxy resins (b) an alkylene oxide addition product of a dihydric phenol compound or a glycidyl ether of the product, (c) a compound having one active hydrogen capable of reacting with the epoxy resin (a), and (d) a compound having at least two active hydrogen capable of reacting with the epoxy resin (a).

The above resins may be used in conjunction with other resins such as an epoxy resin (e.g. polycondensation products between bisphenol A and epochlorohydrin), a polyamide resin, an urethane resin, a phenol resin, a butyral resin, rosin, modified rosin or terpene resin.

Suitable coloring agents for use in the toner of the present invention include known pigments and dyes. These pigments and dyes can be used alone or in combination.

Specific examples of black pigments include carbon black, oil furnace black, channel black, lamp black, acetylene black, azine type dyes such as aniline black; metal-containing azo dyes, metal oxides and complex metal oxides.

Specific examples of yellow pigments include cadmium yellow, mineral fast yellow, nickel titanium yellow, naples yellow, naphthol yellow S, Hansa Yellow G, Hansa yellow 10G, Benzidine Yellow GR, Quinoline Yellow Lake, Permanent Yellow NCG and Tartrazine Yellow Lake.

Specific examples of orange pigments include molybdenum orange, Permanent Orange GTR, Pyrazolone Orange, Vulcan Orange, Indanthrene Brilliant Orange RK, Benzidine Orange G and Indanthrene Brilliant Orange GK.

Specific examples of red pigments include red iron oxide, cadmium red, Permanent Red 4R, Lithol Red, Pyrazolone Red, calcium salt of Watchung Red, Lake Red D, Brilliant Carmine 6B, eosine lake, Rhodamine Lake B, Alizarine Lake and Brilliant Carmine 3B.

Specific examples of purple pigments include Fast Violet B and Methyl Violet Lake.

Specific examples of blue pigments include cobalt blue, Alkali Blue, Victoria Blue Lake, Phthalocyanine Blue, metal-free Phthalocyanine Blue, partially-chlorinated Phthalocyanine Blue, Fast Sky Blue and Indanthrene Blue BC.

Specific examples of green pigments include Chrome Green, chromium oxide, Pigment Green B and Malachite Green Lake.

Examples of the charge controlling agents include positive charge-controlling agents such as nigrosine dyes, quarternary ammonium compound and imidazol metal complexes or salts; and negative charge-controlling agents such as complexes or salts (e.g. Co, Cr, and Fe metal complexes) of aromatic hydroxycarboxylic (e.g. salicylic acid), boron complexes or salts and calix arene compounds.

If desired, the toner can contain a releasing agent, such as a low molecular weight polypropylene, a low molecular weight polyethylene, an alkyl ester of phosphoric acid or a wax (e.g. such as candelilla wax, carnauba wax, rice wax, montan wax, paraffin wax or sasol wax). For the prevention of offsetting during a toner image fixation stage, it is preferred that the releasing agent have a melting point of 65–90° C.

It is desirable that the toner have sufficient fluidity for reasons of improving durability and transferability to a latent image bearing surface. To this end, a fluidity improving agent in the form of a fine powder such as metal oxide powder or complex metal oxide powder may be added into the toner. The metal of the metal oxide may be, for example, Si, Ti, Al, Mg, Ca, Sr, Ba, In, Ga, Ni, Mn, W, Fe, Co, Zn, Cr, Mo, Cu, Ag, V or Zr. The use of silica, titania or alumina is particularly preferred. It is preferred that surface of the metal oxide be modified to become hydrophobic. Such a hydrophobicity improving agent may be, for example, dimethyldichlorosilane, trimethylchlorosilane, methyltrichlorosilane, allyldimethylchlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinylmethoxysilane, vinyl-tris(β-methoxyethoxy)silane, γ-methacryloxypropyltrimethoxysilane, vinyltriacetoxysilane, divinyldichlorosilane, dimethylvinylsilane, octyltrichlorosilane, decyltrichlorosilane, nonyltrichlorosilane, (4-tert-propylphenyl)-trichlorosilane, (4-tert-butylphenyl)-trichlorosilane, dibenzyldichlorosilane, dihexyldichlorosilane, dioctyldichlorosilane, dinonyldichlorosilane, didecyldichlorosilane, didodecyldichlorosilane, dihexadecyldichlorosilane, (4-tert-butylphenyl)-octyldichlorosilane, dioctenyldichlorosilane, didecenyldichlorosilane, dinonyldichlorosilane, di-2-ethylhexyldichlorosilane, di-3,3-dimethylbenzyldichlorosilane, trihexylchlorosilane, trioctylchlorosilane, tridecylchlorosilane, dioctylmethylchlorosilane, octyldimethylchlorosilane, (4-tert-propylphenyl)diethylchlorosilane, octyltrimethylsilane, hexamethyldisilazane, hexaethyldisilazane, diethyltetramethylsilazane, hexaphenyldisilazane or hexatolyldisilazane. A titanate coupling agent or an aluminum coupling agent may also be used as the hydrophobicity imparting agent.

The fluidity improving agent may be used in an amount of 0.1–2% by weight based on the weight of the toner. Too large an amount of the fluidity improving agent in excess of 2% by weight will cause toner dispersion in the image, fouling of inside of the image forming machine and injury of the photoconductor.

One or more other conventional additives may also be incorporated into the toner, if desired. Examples of such additives include lubricant powder such as teflon powder, zinc stearate powder or polyvinylidene fluoride powder; polishing agent such as cerium oxide powder, silicon carbide powder or strontium titanate powder; an electric conductivity imparting agent such as carbon black powder, zinc oxide powder and tin oxide powder; and a development improving agent such as white or black fine powder of an opposite charge.

The toner according to the present invention may be prepared as follows.

First, the above-described ingredients, in the form of powder, including the binder, coloring agent and charge controlling agent are mixed with each other using a mixer such as Henschel mixer to obtain a mixture.

The mixture is then kneaded at a temperature higher than the melting point of the binder using a suitable kneader. A single axis type (or single cylinder type) kneader or two axis type (or two cylinder type) continuous extruder may be suitably used as the kneader. Examples of the two axis type continuous extruder include Model KTK two axis extruder (manufactured by Kobe Steel Ltd.), Model TEM two axis extruder (manufactured by Toshiba Machine Co., Ltd.), Model PCM two axis extruder (manufactured by Ikegai Iron Works Co., Ltd.) and Model KEX two axis extruder (manufactured by Kurimoto Iron Works Co., Ltd.). The single axis continuous kneader may be, for example, Co-Kneader (manufactured by Buss Inc.).

It is preferred that the kneading be carried out while applying a specific energy of at least 0.15 kW·h/kg to the mixture in the production of a toner containing particles having a particle diameter of 5.04 $\mu$m or less in an amount of greater than 15% but not greater than 60% based on the total particle number N of the toner. In this case, it is also preferred that the kneading be carried out while applying a specific energy density of 0.3 kW·h/kg/min or less to the mixture.

In the production of a toner containing particles having a particle diameter of 5.04 $\mu$m or less in an amount of 15% or less based on the total particle number N of the toner, it is preferred that the kneading be carried out while applying a specific energy of at least 0.10 kW·h/kg to the mixture. In this case, it is also preferred that the kneading be carried out while applying a specific energy density of 0.2 kW·h/kg/min or less to the mixture.

The specific energy (SE) and the specific energy density (SED) are defined as follows:

$$SE=\{(PK)-(PN)\}/WM$$

where PK represents a power (kW·h) during the kneading stage, PN represents a power (kW·h) in a non-loading stage and WM represents the amount (kg) of the mixture kneaded.

$$SED=SE/KT$$

where SE is a specific energy as defined above and KT is a time period (minute) through which the shear is applied to the mixture.

A specific energy less than the above lower limit is insufficient to apply sufficient shearing forces to the mixture and to uniformly disperse the charge controlling agent to throughout the toner particles. When the specific energy density is greater than the above upper limit, large shearing forces are applied to the mixture within a short period of time. This will raise the temperature of the mixture by shearing forces to lower the melt viscosity thereof. Thus the shearing forces are not effectively utilized to disperse the charge controlling agent. Thus, the dispersion of the charge controlling agent is desirably carried out slowly while preventing the generation of heat by shearing.

The specific energy may be increased by decreasing the amount of the mixture kneaded and/or by lowering the kneading temperature so that the kneading mass has a high melt viscosity. The specific energy density may be decreased by lowering the shearing force and by increasing the length of kneading zone through which the mixture passes.

The kneaded mixture is then solidified and the solidified mixture is grounded with, for example, a hammer mill and then finely pulverized with, for example, a mechanical pulverizer or a pulverizer using jet air. The pulverized mixture is then sieved or classified with, for example, a classifier using a swirling air flow or a classifier utilizing the Coanda effect, thereby obtaining a toner. If necessary, the toner is mixed with a fluidity improving agent using a mixer such as a Henschel mixer and the mixture is sieved with a sieve (e.g. 250 Tyler mesh) to remove large particles.

The toner according to the present invention may be suitably used in conjunction with a carrier as a two component-type developer. Any known carrier may be used. Examples of carriers include magnetic particles such as iron powder, ferrite powder, nickel powder or magnetite powder; coated particles composed of the above magnetic particles as a carrier core and a resin coating, such as a fluorine resin, a vinyl resin or a silicone resin, surrounding the core; and dispersion-type particles each containing the above magnetic particles dispersed within a resin matrix. The carrier generally has a weight average particle diameter of 35–75 $\mu$m.

The following examples will further illustrate the present invention. Parts are by weight.

EXAMPLE 1

| | |
|---|---|
| Polyester resin (binder) | 100 parts |
| Carbon black (coloring agent) | 10 parts |
| Zinc salicylate (charge controlling agent) | 3 parts |

The above raw powder ingredients were mixed thoroughly with a mixer and melted and kneaded in a two axis extruder. The kneading was performed while controlling the kneading pattern, kneading temperature and feed amount so that the specific energy and specific energy density were maintained at 0.14 kW·h/kg and 0.07 kW·h/kg/min, respectively. The kneaded mixture was pressed, cooled, roughly ground with a cutter mill, finely pulverized with a jet air-type and classified with a rotary air classifier. The classified product (100 parts) was mixed with 0.3 part of amorphous silica with a Henschel mixer to obtain a toner (1A) according to the present invention having particle size distribution as summarized in Table 1. The toner (1A) was further classified to obtain a size-controlled toner (1B) having a number average particle diameter of 4.37 μm. The toner (1A) and the size-controlled toner (1B) were each measured for the amount of the charge controlling agent using fluorescent X-ray analyzer to reveal that the ratio C1/CT (C1: amount of the charge controlling agent in the size-controlled toner (1B), CT: amount of the charge controlling agent in the toner (1A)) was 1.09.

EXAMPLE 2

Example 1 was repeated in the same manner as described except that the kneading was performed such that the specific energy and specific energy density were maintained at 0.20 kW·h/kg and 0.31 kW·h/kg/min, respectively, thereby obtaining toner (2A) according to the present invention having particle size distribution as summarized in Table 1. The toner (2A) was further classified to obtain a size-controlled toner (2B) having a number average particle diameter of 4.40 μm. The ratio C1/CT of the toner (2B) to toner (2A) was 1.06.

EXAMPLE 3

Example 1 was repeated in the same manner as described except that the kneading was performed using a single axis kneader such that the specific energy and specific energy density were maintained at 0.20 kW·h/kg and 0.10 kW·h/kg/min, respectively, thereby obtaining toner (3A) according to the present invention having particle size distribution as summarized in Table 1. The toner (3A) was further classified to obtain a size-controlled toner (3B) having a number average particle diameter of 4.42 μm. The ratio C1/CT of the toner (3B) to toner (3A) was 1.03.

EXAMPLE 4

| | |
|---|---|
| Polyester resin (binder) | 100 parts |
| Carbon black (coloring agent) | 10 parts |
| Zinc salicylate (charge controlling agent) | 3 parts |
| Low molecular weight polyethylene (releasing agent) | 5 parts |

Example 1 was repeated in the same manner as described except that the raw powder ingredients shown above were used and that the kneading was performed such that the specific energy and specific energy density were maintained at 0.09 kW·h/kg and 0.05 kW·h/kg/min, respectively, thereby obtaining toner (4A) according to the present invention having particle size distribution as summarized in Table 1. The toner (4A) was further classified to obtain a size-controlled toner (4B) having a number average particle diameter of 4.38 μm. The ratio C2/CT (C2: amount of the charge controlling agent in the size-controlled toner (4B), CT: amount of the charge controlling agent in the toner (4A)) was found to be 1.13.

EXAMPLE 5

Example 4 was repeated in the same manner as described except that the kneading was performed such that the specific energy and specific energy density were maintained at 0.12 kW·h/kg and 0.22 kW·h/kg/min, respectively, thereby obtaining toner (5A) according to the present invention having particle size distribution as summarized in Table 1. The toner (5A) was further classified to obtain a size-controlled toner (5B) having a number average particle diameter of 4.40 μm. The ratio C2/CT of the toner (4B) to the toner (4A) was found to be 1.10.

EXAMPLE 6

Example 4 was repeated in the same manner as described except that the kneading was performed using a single axis kneader such that the specific energy and specific energy density were maintained at 0.14 kW·h/kg and 0.07 kW·h/kg/min, respectively, thereby obtaining toner (6A) according to the present invention having particle size distribution as summarized in Table 1. The toner (6A) was further classified to obtain a size-controlled toner (6B) having a number average particle diameter of 4.42 μm. The ratio C2/CT of the toner (6B) to toner (6A) was 1.06.

EXAMPLE 7

Example 6 was repeated in the same manner as described except that the kneading was performed such that the specific energy and specific energy density were maintained at 0.20 kW·h/kg and 0.10 kW·h/kg/min, respectively, thereby obtaining toner (7A) according to the present invention having particle size distribution as summarized in Table 1. The toner (7A) was further classified to obtain a size-controlled toner (7B) having a number average particle diameter of 4.44 μm. The ratio C2/CT of the toner (7B) to toner (7A) was 1.03.

Comparative Example 1

Example 1 was repeated in the same manner as described except that the kneading was performed such that the specific energy and specific energy density were maintained at 0.16 kW·h/kg and 0.35 kW·h/kg/min, respectively, thereby obtaining toner (2A) having particle size distribution as summarized in Table 1. During the kneading, the temperature of the kneaded mixture was higher by 10–20° C. than that in Example 1. The toner (8A) was further classified to obtain a size-controlled toner (8B) having a number average particle diameter of 4.35 μm. The ratio C1/CT of the toner (2B) to toner (2A) was 1.12.

Comparative Example 2

Example 1 was repeated in the same manner as described except that the kneading was performed such that the specific energy and specific energy density were maintained at 0.12 kW·h/kg and 0.10 kW·h/kg/min, respectively, thereby obtaining toner (9A) having particle size distribution as summarized in Table 1. The toner (9A) was further classified to obtain a size-controlled toner (9B) having a number average particle diameter of 4.37 μm. The ratio C1/CT of the toner (9B) to toner (9A) was 1.15.

Comparative Example 3

Example 4 was repeated in the same manner as described except that the kneading was performed with a high shear mode such that the specific energy and specific energy density were maintained at 0.12 kWH/kg and 0.24 kWH/kg/min, respectively, thereby obtaining toner (10A) having particle size distribution as summarized in Table 1. During the kneading, the temperature of the kneaded mixture was higher by 10–150° C. than that in Example 4. The toner (10A) was further classified to obtain a size-controlled toner (10A) having a number average particle diameter of 4.39 μm. The ratio C1/CT of the toner (10B) to toner (10A) was 1.16.

Comparative Example 4

Example 4 was repeated in the same manner as described except that the kneading was performed such that the specific energy and specific energy density were maintained at 0.08 kW·h/kg and 0.10 kW·h/kg/min, respectively, thereby obtaining toner (11A) having particle size distribution as summarized in Table 1. During the kneading, the temperature of the kneaded mixture was higher by 10–150° C. than that in Example 4. The toner (11A) was further classified to obtain a size-controlled toner (11B) having a number average particle diameter of 4.42 μm. The ratio C1/CT of the toner (11B) to toner (11A) was 1.20.

TABLE 1

| Example No. | Weight Average Particle Diameter of Toner (μm) | Particles of ≦ 5.04 μm Number % | Number Average Particle Diameter (μm | Particles of 5.04–12.7 μm Number % | Weight Average Particle Diameter (μm) | Particles of ≧ 16 μm Weight % |
|---|---|---|---|---|---|---|
| 1 | 7.48 | 35.1 | 4.41 | 64.8 | 7.43 | 0.00 |
| 2 | 7.50 | 33.6 | 4.49 | 65.2 | 7.45 | 0.00 |
| 3 | 7.51 | 33.4 | 4.50 | 65.5 | 7.46 | 0.00 |
| 4 | 8.50 | 14.8 | 4.44 | 82.8 | 8.49 | 0.15 |
| 5 | 8.45 | 14.2 | 4.45 | 83.0 | 8.44 | 0.16 |
| 6 | 8.52 | 13.5 | 4.61 | 83.5 | 8.55 | 0.15 |
| 7 | 8.47 | 13.0 | 4.65 | 84.1 | 8.46 | 0.13 |
| Comp. 1 | 7.47 | 35.8 | 4.40 | 64.6 | 7.43 | 0.00 |
| Comp. 2 | 7.45 | 36.1 | 4.41 | 64.4 | 7.40 | 0.00 |
| Comp. 3 | 8.46 | 14.1 | 4.45 | 83.2 | 8.45 | 0.17 |
| Comp. 4 | 8.53 | 13.8 | 4.60 | 83.3 | 8.51 | 0.15 |

Each of the thus obtained toners (1A to 11A) was mixed with a coat carrier with a mixing ratio of the toner to the carrier of 2.5:97.5 to obtain two-component developers. The coat carrier was composed of ferrite core having an average particle diameter of 60 μm and covered with a silicone resin layer. The developers were each measured for the amount of counter charge toner and tested for background stains as follows.

Amount of Counter Charge Toner

Sample developer (6 g) is passed through a gap between a pair of opposing electrodes between which a voltage of 500 V is impressed. Toner particles adhered on the negative electrode are then collected using an adhesive tape. The density of the toner on the tape is measured with a Macbeth densitometer. A density of 0.17 or less is desired.

Background Stains

Sample developer is charged in a copying machine (IMAGIO DA505 manufactured by Ricoh Company Limited). Using an image evaluation standard S-3 as an original, 10,000 copies are continuously produced. Background is observed with a magnifying glass to count the number (n) of toner particles present in a circular area of a diameter of 2 mm. Background stains in the initial copy and 10,000th copy are evaluated according to the following ratings.

| | |
|---|---|
| n < 30 | Rank 5 |
| 30 ≦ n < 50 | Rank 4 |
| 50 ≦ n < 200 | Rank 3 |
| 200 ≦ n | Rank 2 |

Similar counts are obtained for a total 10 areas, from which an average of the rank is calculated. Average Rank 4 or more is desired.

The results are summarized in Table 2.

TABLE 2

| Example No. | Density (Amount of counter charge toner) | Background stains (Average Rank) Initial | After 10K run |
|---|---|---|---|
| 1 | 0.17 | 4.5 | 4 |
| 2 | 0.16 | 4.5 | 4.5 |
| 3 | 0.14 | 5 | 5 |
| 4 | 0.16 | 4 | 4 |
| 5 | 0.15 | 4.5 | 4.5 |
| 6 | 0.14 | 4.5 | 4.5 |
| 7 | 0.14 | 5 | 5 |
| Compartive Ex. 1 | 0.18 | 3 | 3 |
| Compartive Ex. 2 | 0.20 | 2.5 | 2.5 |

TABLE 2-continued

| Example No. | Density (Amount of counter charge toner) | Background stains (Average Rank) Initial | After 10K run |
|---|---|---|---|
| Compartive Ex. 3 | 0.19 | 2.5 | 2.5 |
| Compartive Ex. 4 | 0.20 | 2 | 2 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A toner for developing an electrostatic image, comprising a binder, a coloring agent and a charge controlling agent and having the following characteristics (a), (b), (c), (d) and (e):

(a) said toner has a weight average particle diameter of 6.0 to 11.5 μm, a total particle number N and a total weight W;

(b) that portion of said toner which has a particle diameter of 5.04 μm or less accounts for greater than 15% but not greater than.60% of the total number N of said toner and has a number average particle diameter of 4.0 to 4.5 μm;

(c) that portion of said toner which has a particle diameter of greater than 5.04 μm but not greater than 12.7 μm accounts for 40 to 90% of the total number N of said toner and has a weight average particle diameter of 6.0 to 9.5 μm;

(d) that portion of said toner which has a particle diameter of 16 μm or more is not more than 2% based on the total weight W of said toner; and (e) that portion of said toner which provides a number average particle diameter of 4.0 to 4.5 μm has such a content C1% by weight of the charge controlling agent that gives a ratio of C1/CT of 1.00 to 1.10, where CT is a total amount, in terms of % by weight, of said charge controlling agent in said toner.

2. A toner for developing an electrostatic image, comprising a binder, a coloring agent and a charge controlling agent and having the following characteristics (a), (b'), (c), (d) and (e'):

(a) said toner has a weight average particle diameter of 6.0 to 11.5 μm, a total particle number N and a total weight W;

(b') that portion of said toner which has a particle diameter of 5.04 μm or less accounts for 15% or less of the total number N of said toner and has a number average particle diameter of 4.2 to 4.8 μm;

(c) that portion of said toner which has a particle diameter of greater than 5.04 μm but not greater than 12.7 μm accounts for 40 to 90% of the total number N of said toner and has a weight average particle diameter of 6.0 to 9.5 μm;

(d) that portion of said toner which has a particle diameter of 16 μm or more is not more than 2% based on the total weight W of said toner; and (e') that portion of said toner which provides a number average particle diameter of 4.2 to 4.8 μm has such a content C2% by weight of the charge controlling agent that gives a ratio of C2/CT of 1.02 to 1.15, where CT is a total amount, in terms of % by weight, of said charge controlling agent in said toner.

3. A process for the preparation of a toner according to claim 1, said process comprising the steps of:

mixing the binder in the form of a powder, the coloring agent in the form of a powder and the charge controlling agent in the form of a powder to obtain a mixture;

kneading said mixture at a temperature higher than the melting point of said binder;

solidifying the kneaded mixture and grinding the solidified mixture; and sieving said ground mixture, said kneading being carried out while applying a specific energy of at least 0.15 kW·h/kg to the mixture.

4. A process as claimed in claim 3, wherein said kneading is carried out while applying a specific energy density of 0.3 kW·h/kg/min or less to the mixture.

5. A process for the preparation of a toner according to claim 2, said process comprising the steps of:

mixing the binder in the form of a powder, the coloring agent in the form of a powder and the charge controlling agent in the form of a powder to obtain a mixture;

kneading said mixture at a temperature higher than the melting point of said binder;

solidifying the kneaded mixture and grinding the solidified mixture; and sieving said ground mixture, said kneading being carried out while applying a specific energy of at least 0.1 kW·h/kg to the mixture.

6. A process as claimed in claim 5, wherein said kneading is carried out while applying a specific energy density of 0.2 kW·h/kg/min or less to the mixture.

* * * * *